United States Patent [19]

Winston et al.

[11] Patent Number: 4,661,045

[45] Date of Patent: Apr. 28, 1987

[54] LEAKAGE DETECTION IN REMOTE SUPPLY PAINTING SYSTEM

[75] Inventors: Walter E. Winston, Carmel; Lowell G. Atkinson, Indianapolis, both of Ind.

[73] Assignee: Triune Automated Painting Systems, Carmel, Ind.

[21] Appl. No.: 821,450

[22] Filed: Jan. 22, 1986

Related U.S. Application Data

[60] Continuation-in-part of Ser. No. 564,724, Dec. 23, 1983, Pat. No. 4,576,553, which is a division of Ser. No. 218,354, Dec. 22, 1980, Pat. No. 4,424,011.

[51] Int. Cl.[4] ..... F04B 49/10

[52] U.S. Cl. ..... 417/9; 417/477

[58] Field of Search ..... 417/9, 476, 477, 214, 417/319, 295, 474, 63

[56] References Cited

U.S. PATENT DOCUMENTS

| | | | |
|---|---|---|---|
| 3,105,442 | 10/1963 | Howerton | 417/295 X |
| 3,176,623 | 4/1965 | Howerton et al. | 417/9 |
| 4,289,459 | 3/1986 | Neeley | 417/9 |

*Primary Examiner*—Leonard E. Smith

*Attorney, Agent, or Firm*—Woodard, Weikart, Emhardt & Naughton

[57] ABSTRACT

A painting apparatus has a peristaltic pump having a pump cavity in a pump body and a pumping tube in the cavity. The cavity is provided with an elongate drain passage. A photoelectric sensor is arranged to receive light from a light source, both being associated with the drain passage to sense any leakage of paint from the pumping tube draining into the drain passage and to thereupon stop the pump. An alert light may be provided for signalling that paint leakage has stopped the pump. Preferably, a funnel-like transparent container is removably fitted in the cavity below the pumping tube to receive the paint leakage. The container has a spout-like downward extension engaged in the drain passage but allowing transmission of light to the photoelectric sensor. The drain passage preferably has an open front to facilitate inspection and cleaning of the light source and photoelectric sensor, although presence of the removable container mitigates the need for such cleaning, and the container can be discarded and replaced when soiled with leakage paint.

23 Claims, 16 Drawing Figures

LEAKAGE DETECTION IN REMOTE SUPPLY PAINTING SYSTEM

CROSS REFERENCES TO RELATED APPLICATIONS

This application is a continuation-in-part of application Ser. No. 564,724 filed Dec. 23, 1983, now U.S. Pat. No. 4,576,553, which is a division of application Ser. No. 218,354 filed Dec. 22, 1980 and now issued as U.S. Pat. No. 4,424,011 on Jan. 3, 1984.

FIELD OF THE INVENTION

This invention relates generally to application of fluidized coatings to rather large areas on surfaces which are usually stationary, typically walls and ceilings of structures. It relates more particularly to leakage detection of paint or the like leaking in or from a pressurizing unit supplying the paint or the like to an applicator.

BACKGROUND OF THE INVENTION

Over many years there have been numerous proposals for power painting systems. Among these, for example, it has been suggested in U.S. Pat. No. 3,230,570 to employ a peristaltic pump. Such a pump provides the advantage that it facilitates cleaning after painting, or when changing color, since the paint passes through the pump inside a tube and does not come into contact with any other parts of the pump, only this tube requiring cleaning. However, there is the danger that this tube may rupture, or otherwise develop a leak, during use with consequential leakage of paint from the pump. Should such leakage go undetected, particularly if painting is being performed at a location rather remote from the pump, then considerable inconvenience could be caused by the leaking paint.

SUMMARY OF THE INVENTION

It is an object of the present invention to provide a leakage detection arrangement for a painting system employing a pump, particularly a peristaltic pump.

A feature by which this is achieved, is the use of photoelectric sensing associated with a passageway extending downwardly at the bottom of the pump to detect leakage before, or at least as, it leaves the pump. Advantageously, the pump may be automatically turned off when a leakage is so detected. Not only does this minimize further leakage, but it can provide the operator with a warning that something is wrong and to inspect the pump.

A further optional preferred feature is the incorporation of a leakage container in the pump to collect inside the pump any such leakage, the photoelectric sensing preferably being associated with a closed extension of the container located in the passageway at the bottom of the pump. This provides the advantage that while the leakage is being detected, it is collected in the leakage container and is restrained from spilling onto the floor; it also provides a second line of defense for detecting leakage as will be explained later.

Accordingly, therefore, there is provided by the present invention a painting apparatus having a pump with a pump cavity in a pump body, a pumping tube in the cavity, and means for acting upon the tube to pump paint therethrough. The cavity extends below the pumping tube and is provided with a drain passage. A photoelectric sensor is arranged to receive light from a light source, the sensor and the light source being associated with the drain passage to sense leakage of paint from the pumping tube draining into the drain passage and thereupon to stop the pumping action of the pump.

Alert means may be provided for signalling that the photoelectric sensor has stopped the pump responsive to leakage of paint.

Preferably, the drain passage is elongate and the photoelectric sensor and the light source are disposed on opposite sides of the passage intermediate the length of the passage. Advantageously, the passage may be open on a front side thereof along the length of the passage.

Advantageously, a container may be fitted in the cavity below the pumping tube to receive paint leakage. The container may have a downward extension extending into the passage, this extension allowing transmission of light from the light source to the photoelectric sensor. Preferably the container is transparent, and may be funnel-shaped with the extension being spout-like but closed at the bottom. The container may have side flanges releasably engaging means on the pump body for locating the container in the cavity.

Advantageously, the open top of the container may be squeezed between a back wall of the cavity and a door of the pump when the door is closed to close the cavity; such squeezing creates effective sealing around the top of the container to reduce the risk of any leakage paint seeping past the sides of the container. However, even if such seepage occurred, it would drain from the cavity down the drain passage past the photoelectric sensor, although clean up of the seepage would be necessary.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

The preferred embodiment of the invention is illustrated by way of example in FIGS. 10 to 13, and two other embodiments of the invention are illustrated in FIGS. 1 to 8, and FIG. 9, respectively. The circuitry of FIG. 14 is applicable to all these embodiments.

The embodiment shown in FIGS. 1 to 8 will be described first.

Figure 1:
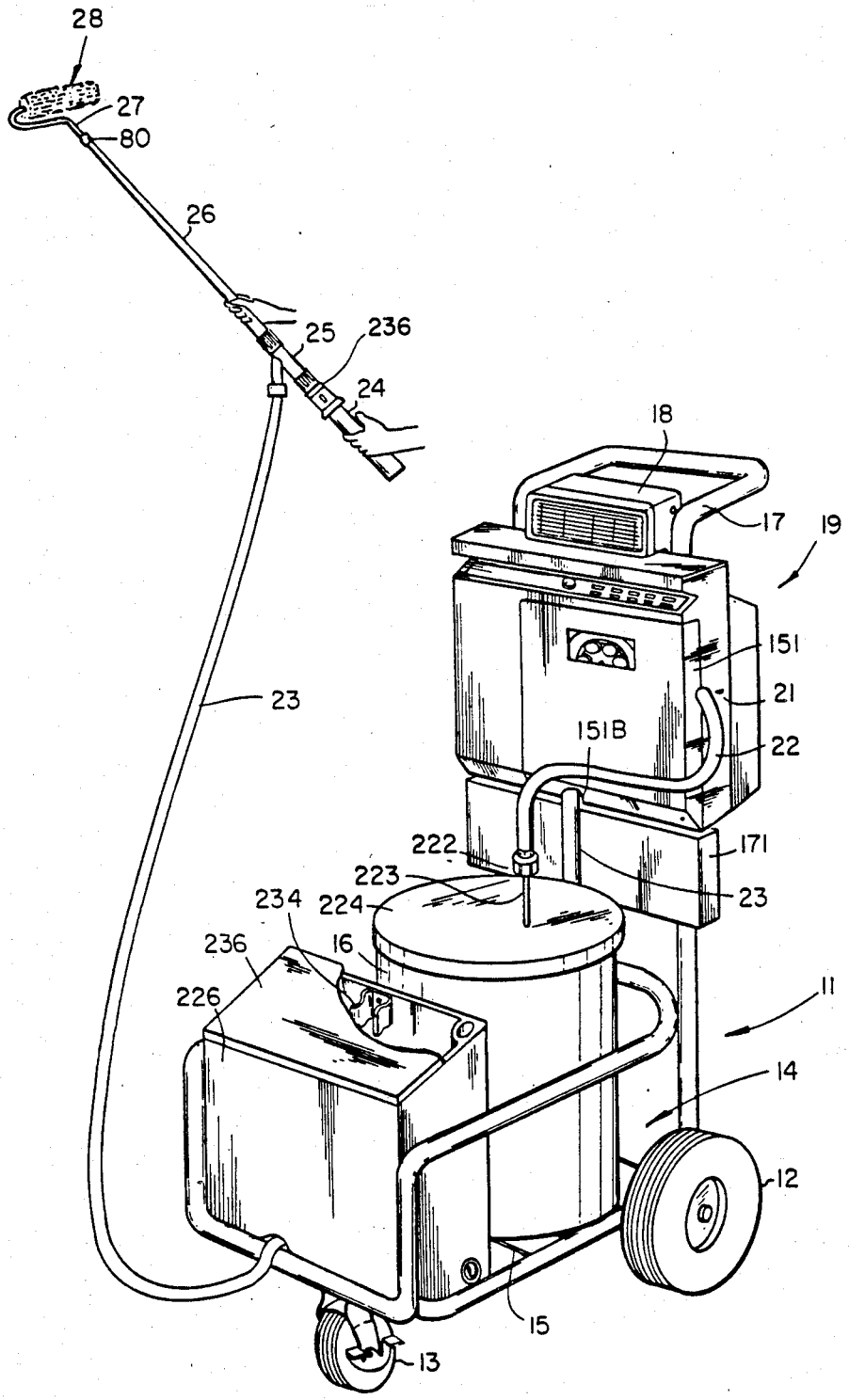
FIG. 1 is a front perspective view of a power painting system according to the invention with a pump unit supported on a handle section of a cart.
Figure 2:
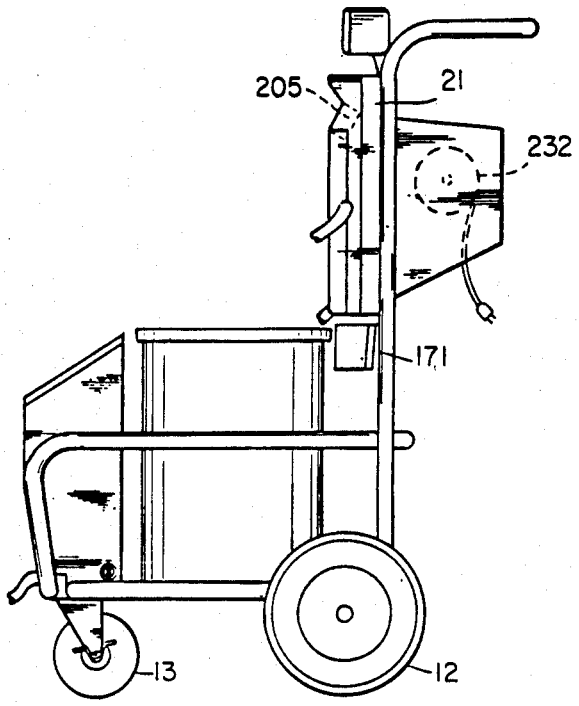
FIG. 2 is side elevational view of the cart of FIG. 1.

Referring now to FIG. 1, the machine includes a three wheeled cart 11 of tubular metal construction with two wheels 12 at one end and a caster wheel 13 at the other. The cart includes a nest 14 (see FIG. 4) of small horizontal support rods 15 cooperating with the tubing of the cart frame and receiving a paint can 16 (typically of the five gallon size). An inverted U-shaped handle 17 is provided at the rear of the cart, and serves as a mount for a pump assembly 19 having a light 18 on it to assist in illuminating the work.

The pump assembly 19 is mounted to the handle 17 and includes a housing 21 with a motor therein for driving a pump, the details of which cannot be seen in FIG. 1 but are shown in some of the other drawings.

The pump has an inlet hose 22, and a discharge hose 23, the latter being connected to a handle 24 of an applicator 28 by a swivel coupling assembly 25. A handle extension tube 26 is connected to the swivel coupling assembly 25, and a roller mounting tube 27 is connected to the distal end of tube 26. A roller assembly 28 is mounted to the roller mounting tube. The preferred form of cover for the roller 28 is provided with pile on a knitted backing and is entirely flexible until mounted on the roller. Accordingly, the roller cover can be readily washed in a washing machine or dry cleaned in a dry cleaning machine, or by hand and can be wrung out by hand. The roller tube 27 is connected to the extension 26 at a coupling 80.

Figures 6, 6A, 6B:
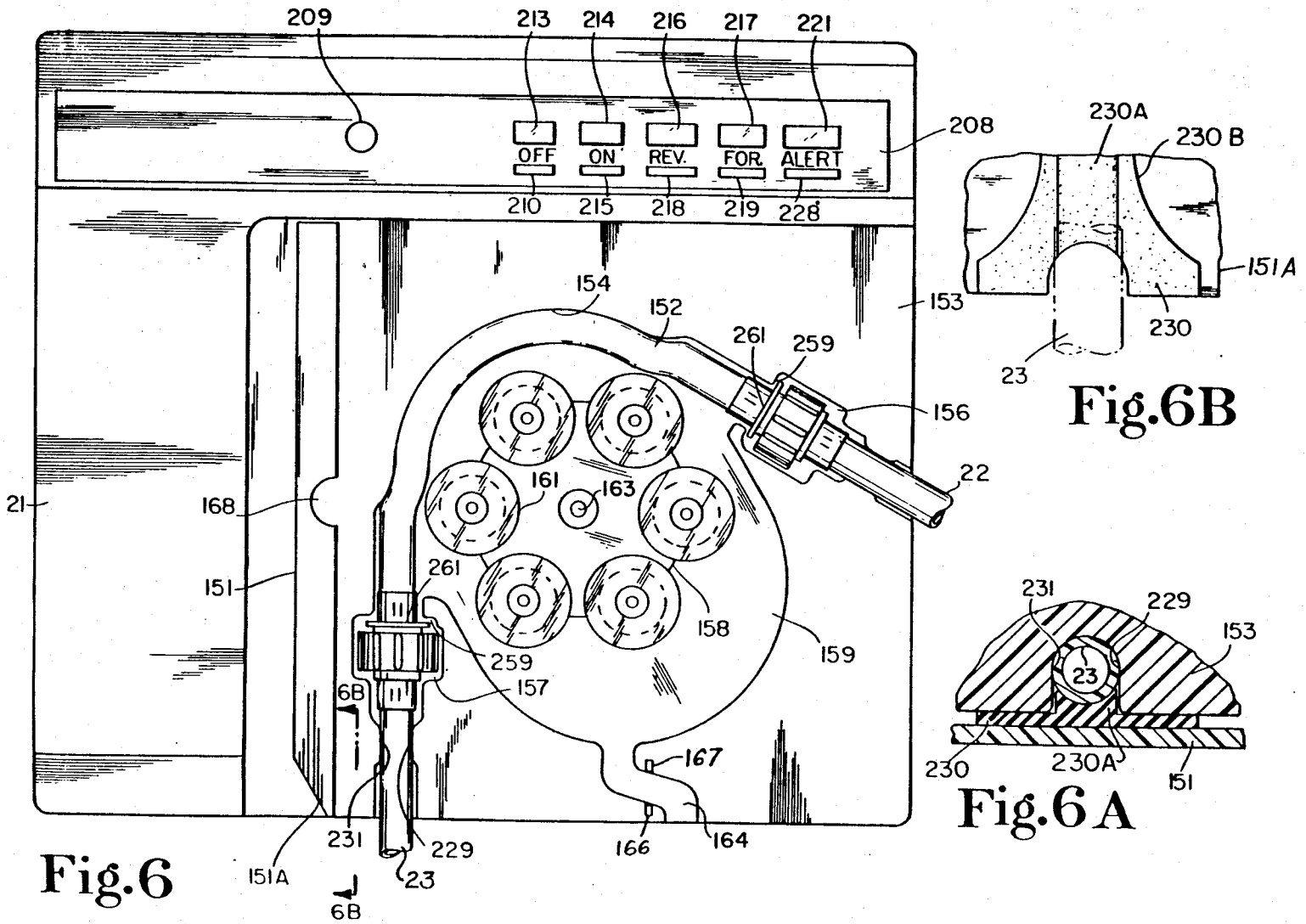
FIG. 6 is a fragmentary front view, on a larger scale, of the pump unit of FIG. 1 with a pump tube access door open.
FIG. 6A is a fragmentary section on the line 6A—6A in FIG. 5 and showing the door and pump base sealing the periphery of the pump hose near the discharge end.
FIG. 6B is an elevational view at the line 6B—6B in FIG. 6 and viewed in the direction of the arrows to show a fragment of the interior face of the door at the base seal gasket.
Figure 8:
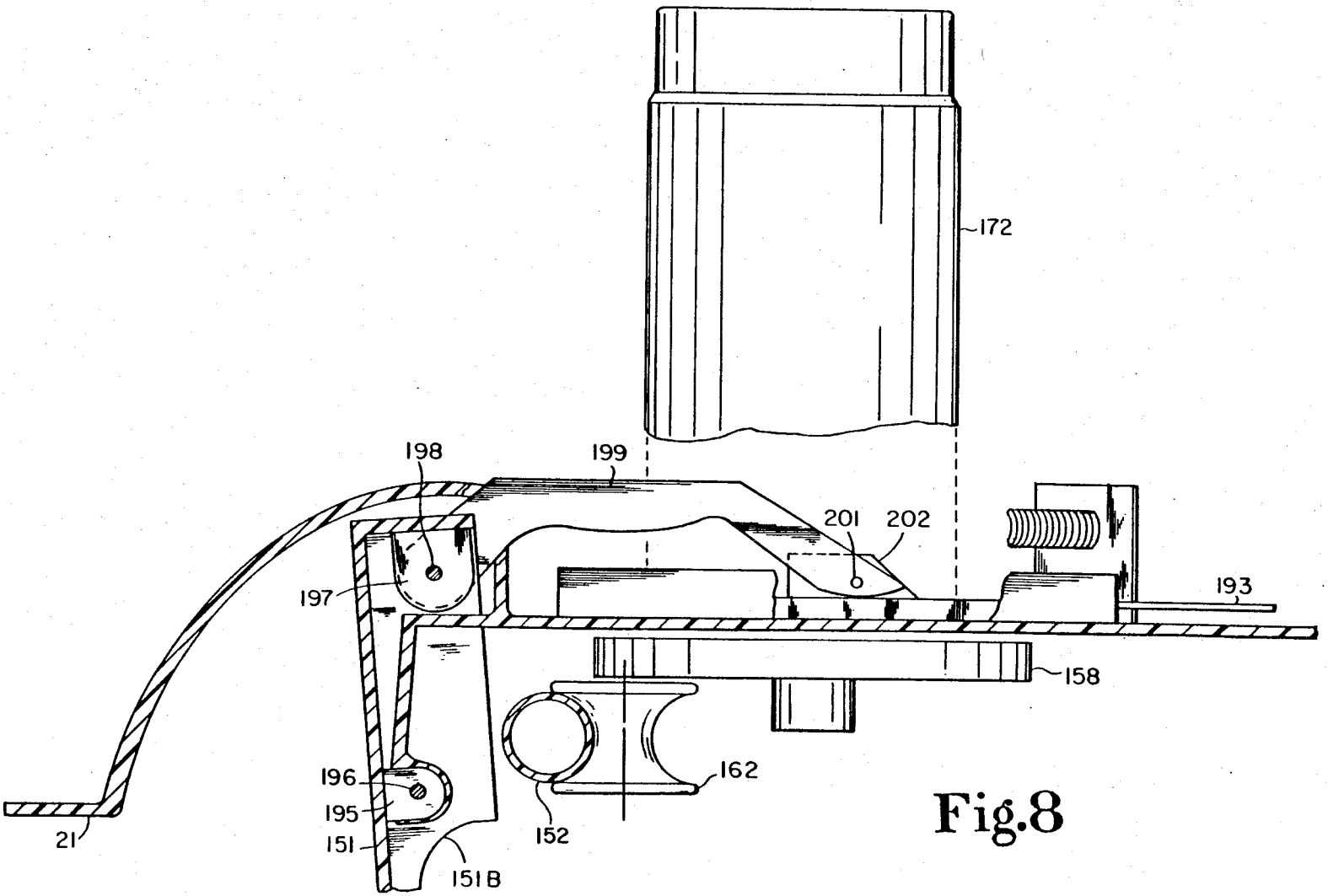
FIG. 8 is a fragmentary top plan view showing the pump motor and mounting portions and door linkage for loading and unloading the pump tube.

The pump housing 21 is provided with a front door 151 with hinges (see 195, 196 in FIG. 8) at the left side whereby the door can be opened to the position shown in FIGS. 6 and 8, where it exposes the pump tube 152 received in a cavity 159 in a stationary wall 153 in the pump housing. One wall of the cavity 159 is a cam surface 154 which generally faces downward and to the right to support the pump tube 152 against forces directed generally upward and to the left. The pump tube is connected to the inlet hose 22 at a coupling 156, and it is connected to the discharge hose 23 at a coupling 157.

A rotor 158 is received in the pump cavity 159 and supports six rollers, three of them being flat faced pressure rollers 161, and three of them being grooved, tube confining and reforming idler rollers 162 (see FIG. 7) of the same outside diameter as the pressure rollers. The rotor 158 rotates about a horizontal axis 163 at its center and which is perpendicular to the plane of operation of the rollers.

Figure 3:
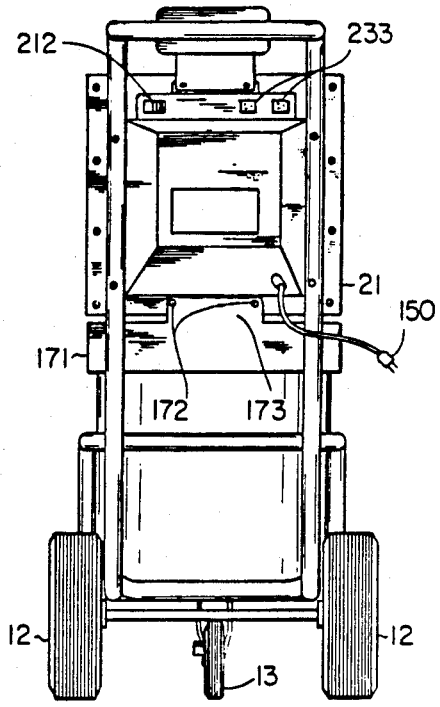
FIG. 3 is a rear elevational view of the cart of FIG. 1.
Figure 4:
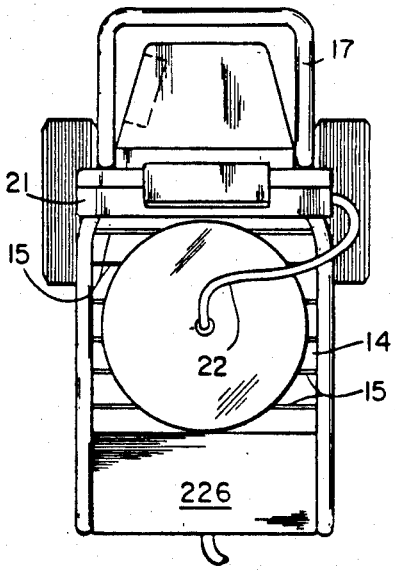
FIG. 4 is a top plan view of the cart of FIG. 1.

The pump cavity is provided with a drain passageway 164 with a lamp 166 focused upward through a window in the bottom of a horizontally extending portion of the drain passageway onto a photocell 167 for detection of passage of any fluid down through the drain passageway, and which would be indicative of a leak in the pump assembly. An open topped safety tray 171 (shown in FIGS. 1 to 3 and 5) is located under the drain passageway outlet and extends the full width of the pump housing to receive any leakage from passageway 164. It is hung on the back of the housing 21 by a pair of hooks 172 through eyes on a hanger portion 173 of the trough (FIG. 3). A notch 168 in an edge of the door 151 (FIG. 6) accommodates the hose 22, when the door is closed.

Figure 5:
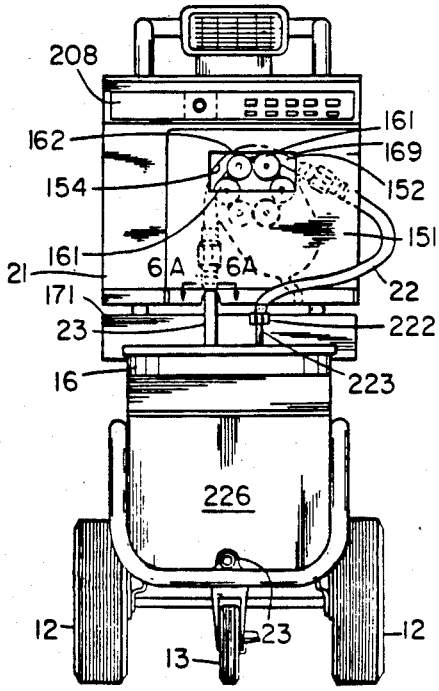
FIG. 5 is a front elevational view of the cart of FIG. 1.

As shown in FIG. 5, when the door is closed, one can see a portion of the pump through a window 169. It may be noted in this view that the pressure rollers 161 have forced the lower wall portion of the pump tube 152 toward the cam surface 154, and an idler roller 162 also is in position of engagement with the pump tube. The shifting of the pump rotor and rollers from the tube compressing position shown in FIG. 5 to the tube release position of FIG. 6 is accomplished simultaneously with the opening of the door.

Referring to FIG. 8, a reversible motor 172 is mounted to a slide received in tracks so that the motor can be moved in relation to the pump housing. The pump rotor 158 is secured to the motor shaft, so that when the motor is moved in a direction towards the cam surface 154 (FIG. 6), the rotor 158 is also moved in the same direction toward the cam surface 154 to apply the rollers to the pump tube 152.

The door 151 has hinge brackets 195 which mount on a vertical hinge pivot axis 196 on the pump housing and which has a fixed relationship to the cam 154 (not shown in FIG. 8). An arm 197 on the rear of the door is fastened by a pin 198 to a link 199 the other end of which is pinned at 201 to a bracket 202 secured to the back of a slide 193.

Figure 7:
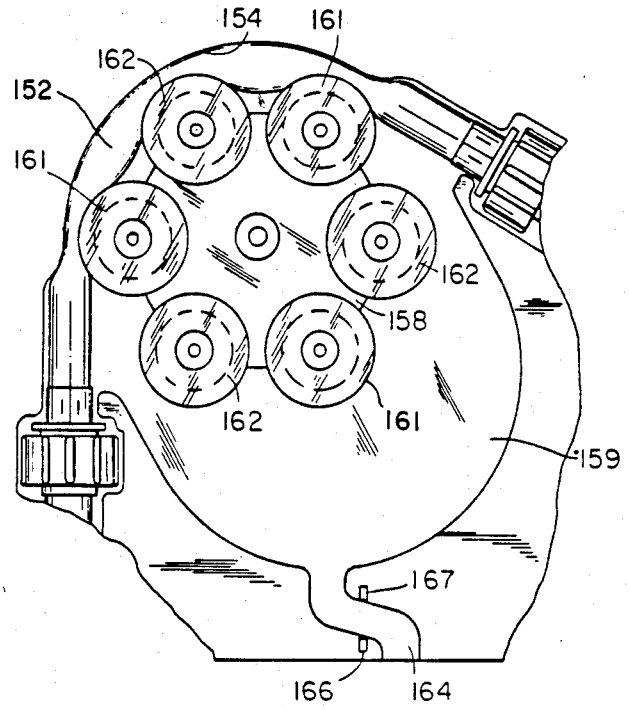
FIG. 7 is a fragmentary front view of the pump of FIG. 6 but omitting the door and showing the pressure rollers engaged with the pump tube as during pumping.

As the door is opened from the closed position, link 199 pushes the slide 193 which moves the motor to pull the rollers away from the pump tube 152 to the position shown in FIG. 6. When the door 151 is again closed, the link 199 pulls the slide 193 to effect resilient loading of the rollers 161, 162 against the pump tube 152 as shown in FIG. 7.

This resilient loading of the rollers 161, 162 can be adjusted to establish the amount of paint pressure which can be developed in the pump tube before the tube will push the pump rollers in a direction away from the cam surface 154 against the resilient loading. This thereby limits the pump pressure, even though the door remains shut.

Referring to FIG. 3, a switch 212 at the top rear of the housing is for power to the unit. This unit is equipped to be radio controlled from the applicator handle 24, and the power switch 212 is arranged to power up a radio receiver and make power available to the pump motor, subject only to the control functions. The radio receiver and control electronics are integrated on one circuit board 205 (dotted in FIG. 2) behind control panel 208. A pump motor controller by Dart Controls Inc., 5000 W. 106th Street, Zionsville, Ind., Model No. 15DC10 is also located behind control panel 208, and coupled to the control electronics.

Referring now to FIG. 6, the pump control panel 208 on the front of the housing 21 includes a series of buttons and indicator lights and a speed control. The speed control is at 209. It is a rotary knob as for a potentiometer. Two lights to the right of the speed control are for the pump. Light 213 indicates that the pump is off, while light 214 indicates that the pump is on. These have associated switch buttons 210 and 215, respectively under them to achieve these functions.

The next two lights to the right are 216 and 217. Light 216 indicates reversed flow, while light 217 indicates forward flow. The flow direction depends upon the direction of pump operation. Accordingly, the switches below each of these lights are a reverse switch 218 for the reverse flow, and a forward switch 219 for forward flow. The alert light 221 is intended to be illuminated whenever there is a leak sensed by the photocell 167, or when some other malfunction is occurring. Switch 228 below light 221 tests the proper functioning of the leak detector and the associated light 221.

Referring again to FIG. 6, it should be understood that the face 153 in the pump housing, which has the cavity 159 therein to accommodate the pump rotor and rollers and the upper portion of which has the cam surface 154 as its wall, also extends to the right-hand and lower marginal edges of that portion of the housing, to thereby receive and pocket the couplings 156 and 157 and the intake hose 22 and outlet hose 23. Accordingly, these components remain securely in place until such time as it is desired to pull them forward out of their nesting cavity to facilitate replacement of the pump tube 152 by disconnecting the couplings 156 and 157. Shoulders 259 of the coupling pockets in face 153 abut the flanges 261 of the male threaded portions of the couplings (which are affixed to the pump tube) to prevent the pump tube from being pulled either way through the cavity 159 during either forward or reverse operation of the pump.

The lower portion 151A of door 151 slopes downwardly towards the back of the pump housing when closed so that its lower edge is over the drip trough (safety tray) 171 whereby any paint which gets on its inside surface will drain into tray 171. Since this portion of the door slopes to the rear, and hose 23 extends straight down from the housing, a hose clearance notch 151B (see FIG. 8) is provided in the door. A resilient gasket 230 (see FIGS. 6A and 6B) is provided on the inside of the door around and above this notch, and has a key portion 230A which extends into the discharge hose groove in housing face 153. It forms and seals around the hose 23 as best shown in FIG. 6A, and seals it at the level where the rest of the circumference of the hose is sealed by the hose groove constriction 229-231, so that any leakage above this level cannot run down the hose. Instead, such leakage will be diverted and run downward and outward along edges 230B (FIG. 6B) of the gasket so it will be further diverted to the drip trough by the rearward sloping wall of the door bottom portion 151A.

The pump housing also includes an electric cord with a power plug 150 (FIG. 3) and a cord reel 232 (FIG. 2) behind the panel to the left of the door 151. Electric convenience outlets 233 are also provided on the rear of the housing.

The applicator handle 24 includes a switch ring 236 (FIG. 1) rotational displacement of which controls operation of a radio transmitter contained, together with a battery and antenna coil therefor, in the handle 24. As an example of the controls, the transmitter and receiver incorporate a set of integrated circuits, one for the receiver and one for the transmitter. These may be of the type originally designed for remote control toy operation. They operate in the 49 mHz citizen's band. The particular devices used are by National Semiconductor, Sunnyvale, Calif. An LM 1871 is used for the transmitter, and LM 1872 is used for the receiver. Although the above-mentioned transmitter and receiver devices are designed for continuous carrier operation, in the present case, the transmitter is keyed only when a command is sent, in order to conserve battery power. Also, for control of the receiver in the present case, it is necessary to be sure that, where several painting applicators according to the present invention are used in the same building, or even in the same room of a building, the transmitter of one will not affect operation of the other. For this purpose, coding is used for each of the control functions. Motorola integrated circuits SC42130 for the receiver, and SC42131 for the transmitter, can be employed for this purpose. These two coding circuits are employed for garage door openers, to differentiate between units for security purposes. Five hundred twelve codes are available. The desired codes can be selected by pencil or probe operated switches associated with the circuits. In use for present purposes, a separate integrated circuit and code selection device can be used for each function to be controlled in the receiver. In the transmitter, one integrated circuit may be used with a switching matrix to program the code differently for each function selected. The above-mentioned example of components is based upon the desire to use off-the-shelf components in a frequency band available for remote control applications with minimum regulatory restrictions. Other arrangements and components might also be selected and devised to perform the desired functions in the painting applicator.

Since the apparatus of the present invention can be used to apply a variety of materials, it is desirable to obtain the maximum available motor performance. For this purpose, it is desirable to avoid excessive motor loading, not only in the steady state, but also avoiding intermittent or pulse or shock-type loading. The provision of three pressure rollers assists in this effort. However, this can be facilitated by the shaping of the pump cavity, particularly the beginning and end of the cam surface 154, as shown in FIGS. 6 and 7.

For additional description and illustrations of the various components and assemblies of the above embodiment illustrated in FIGS. 1 to 8, reference can be made to the above mentioned U.S. Pat. No. 4,424,011 and U.S. patent application Ser. No. 564,724 (subsequently issued as U.S. Pat. No. 4,576,533) the full disclosures of which are hereby incorporated herein by reference.

In operation, the various components are assembled in much the manner described above. The pump intake hose 22 is connected by a suitable conventional garden hose coupling 222 to a combination puncture spear and intake tube 223 in the lid 224 on the paint can 16. This spear may have a sharp end so that it can be actually punched directly through the top of the can of paint, which should have already been stirred or shaken on a power operated shaker or otherwise. Once the roller assembly 28 and handle 24 have been connected, the painter is ready to paint.

During the painting operation, the power switch 212 is placed in the "on" condition, and the painter can then start the pump running by pushing the on button 215 under light 214. He pushes button 219 to provide forward pump operation. He can keep the paint flowing to the roller as long as the pump is running. The speed of the pump, and therefore the volume of delivery, can be controlled by the speed control knob 209. All of these functions, except the power switch 212 and speed control, can likewise be controlled from the handle 24, there being appropriate function controls on the handle for this purpose. Speed control at the handle is also possible.

During a pause in painting, the off switch 210 under the off light 213 can be pushed. this stops the flow of paint. The configuration of the roller, which should be designed to contain very little paint that has not been absorbed by the roller cover, prevents paint from dripping when the pump stops. If the painting is to be interrupted for a prolonged period of time or under circumstances where very wet and/or heavy coats are being applied, the motor can be switched to the reverse position by pushing the button 216 and the on button 215. Thereupon the pump will proceed to drain the entire system back into the paint can. To assist in this function, if desired, the roller can be rolled up and down against a surface. Then the roller itself can be placed in a hanger 234 in a "caddy" 226 in the front of the cart, and hinged cover 236 closed until such time as the painter is ready to resume painting. Since the entire system is sealed and the cover closed on caddy 226, the painting may be interrupted for hours or days without having the paint dry, and painting may be resumed at any time.

If the painting will be terminated, the paint can be pumped back into the paint can as previously described. Then the entire system can be flushed by removing the paint intake spear from the paint can and inserting it in a can of appropriate cleaning solvent (water in the case of water soluble paints), removing the roller cover and replacing the roller in the same can and operating the system to circulate solvent through the system in the normal direction. Another possibility is to reverse the pump operation, and then pump solvent from the roller end into the can. In instances where it may be desirable for economy purposes, to use a unidirectional motor, the effect of reversing the pump can be achieved by reversing the locations of hoses 22 and 23 on their respective couplings 156 and 157, or by threading the pump tube through the pump in the opposite direction, and running the pump in the normal direction.

By making the coupling 222 to the intake spear 223 in a size compatible with conventional garden hose fittings, the system can be drained and flushed without even running the pump motor, by simply connecting the coupling 222 to a hose bib. For this purpose, normally the pump tube 152 is either removed from the pump, or at least the load of the rollers against the tube is released by opening the door 151.

With regard to the leakage detection arrangement, it can be seen in FIGS. 6 and 7 that the leakage passage 164 commences at the lowest point of the pump cavity 159, and the pump cavity is shaped to drain to the leakage passage 164. Also, it can be seen that the leakage passage extends generally downwards and has a length substantially longer than its width; in conjunction with the positioning of the photoelectric sensing 166, 167, this increases the sensitivity for quickly detecting leakage—even only a drop of paint passing down through the passage 164.

FIGS. 9 to 13 show two modifications of the leakage detection and collection arrangement, but otherwise the embodiments of FIGS. 9 to 13 are essentially the same as that shown in FIGS. 1 to 8 and described above. In both FIG. 9 and FIG. 10 the pump tube, the inlet and outlet tubes, and the tube connectors have been omitted for simplicity; however, the pump rotor 158 with three pressure rollers 161 and three idler rollers 162 and the operation and control thereof in each of these modified peristaltic pumps is the same as in FIGS. 6 and 7.

Figure 9:
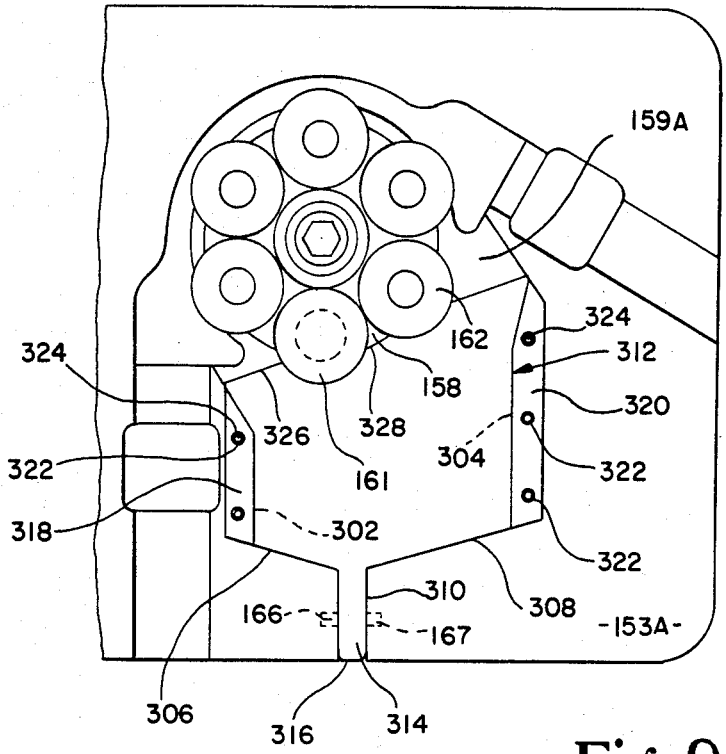
FIG. 9 is a fragmentary front view,somewhat similar to FIG. 7, of the pump of a second embodiment of the invention showing a modified pump housing containing a drip cup.

Turning first to the embodiment of FIG. 9, the cavity 159A in the vertical pump face 153A is differently shaped. The lower portion of this cavity 159A has straight, vertical side walls 302, 304, with the righthand side wall 304 extending higher than the lefthand side wall 302. The bottom of the cavity 159A is formed by straight bottom walls 306, 308 which slope downwardly towards each other and merge into a vertical passageway 310. The passageway 310 is formed by a recess in the bottom of the pump face 153A and is open at its lower end, its upper end communicating with the lowest point in the cavity 159A. The passageway 310 is elongate having a length more than twice its width. A light source 166 and a photoelectric sensor 167 are disposed opposite each other on opposite sides of the passageway 310 intermediate the length of the passageway. A drip cup 312 is located in the cavity 304 and has a downwardly extending extension 314 which fits in the passageway 310. The bottom 316 of the extension 314 is closed. Each side of the drip cup 312 is provided with an integral flat flange 318, 320 which fits loosely in correspondingly shaped shallow recesses in the pump face 153A. Each flange 318, 320 has a plurality of holes 322 in which engage small pins 324 protruding outwardly from the flange recesses on each side of the cavity 159A; these pins 324 accurately locate and retain the drip cup 312 in position. The top of the drip cup is open with the upper back edge 326 sloping upwardly from the top of the lefthand flange 318 to the top of the righthand flange 320. The edge 326 is provided with an arcuate cutaway section 328 intermediate its length to fit under and accommodate the lower portion of the pump rotor 158. The upper front edge (not shown) of the drip cup is similar to the edge 326 but without the cutaway section 328. The drip cup 312 is transparent and molded or blister pack vacuum formed from polyethylene or polypropylene.

Should, in use, the pump tube around the top of the cavity 159A rupture, then paint leaking therefrom will fall into the drip cup 312 and drain to the extension 314 at the bottom thereof. Any such leakage paint will then pass down the extension 314 to the bottom thereof where it will be retained. As this leakage paint drips or flows down the extension 314, it will interrupt or impede the light beam from the light source 166 from being received by the photoelectric sensor 167, which in turn will trigger the alert circuit and instantly stop the pump motor. An alert signal should preferably also be given, such as illumination of the alert light 221 (see FIG. 6). The clear transparency of the drip cup extension 314, in conjuntion with the sensitivity of the sensor 167, should enable a single drop of paint passing down the extension 314 to trigger the alert and stop the motor. However, should for any reason this not occur, then as the paint leakage continues to drip down the extension 314, it will fill the bottom portion thereof until the level of the light 166 and sensor 167 is reached; this will then completely block the light 166 ensuring switching off of the motor. Due to the narrow elongate shape of the extension 314, and positioning the light 166 and sensor 167 intermediate the length thereof, the light 166 will be covered after only a very small volume of leakage paint has been collected by the drip cup.

Apart from the advantage of the extension 314 being able to start filling to provide a second level of defense for leak detection, the drip cup also provides the advantage of keeping the operating surfaces of the light source 166 and sensor 167 clean. Without the drip cup the leakage detection system would work similarly to that in the embodiment of FIGS. 1 to 8, and could be so operated adequately; however, any leakage paint contaminating the exposed surface of either the light source 166 or the sensor 167 would have to be thoroughly cleaned off before again using the painting apparatus. Thorough cleaning of these surfaces is somewhat difficult and tedious due to the dimensions of the rather narrow and elongate passage 310 making access difficult. However, with the drip cup present, the possibility of paint contaminating these surfaces is virtually eliminated; after an occurrence of leakage and after having corrected the cause, it is merely necessary to replace the drip cup to continue painting operations. The drip cup can be manufactured cheaply as a throw away item and readily replaced once soiled.

The preferred embodiment illustrated in FIGS. 10 to 13 will now be described.

Figure 10:
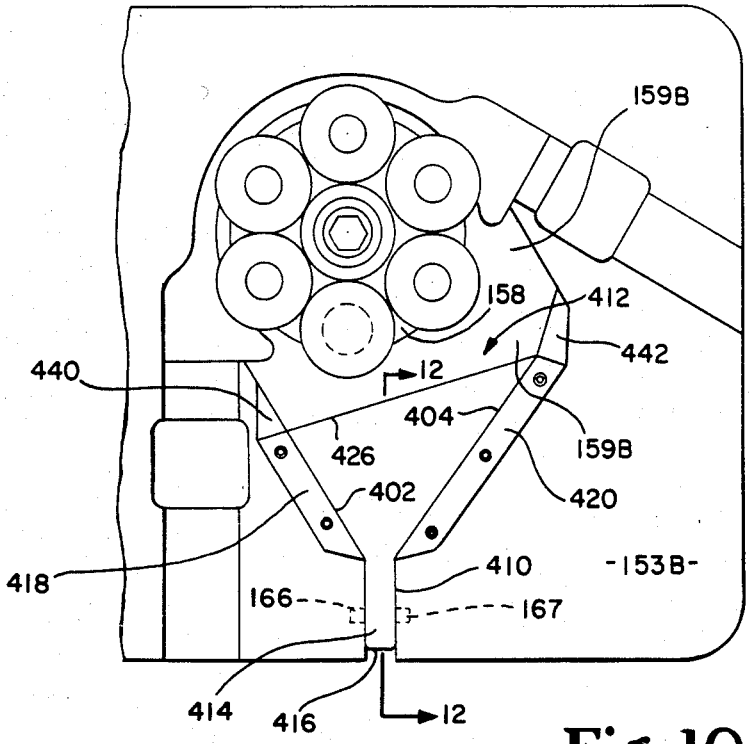
FIG. 10 is a view similar to FIG. 9 of a third embodiment of the invention showing yet a further modified pump housing containing a modified drip cup.

FIG. 10 shows a similar pump arrangement to FIG. 9, the main difference being the shape of the drip cup 412 and the complementary shape of the pump cavity 159B into which it easily but snugly fits. As before, the pump cavity is formed in the pump face 153B. However, the left and right side walls 402, 404 of the drip cup 412 are both sloped downwardly and inwardly towards each other like a funnel with an extension 414 extending downwardly from the bottom of the funnel like the spout of a funnel. Unlike a funnel, the bottom of the extension 414 is closed by a flat bottom wall 416. Flat flanges 418, 420 extend from and along the full length of the side walls 402, 404 and are received in shallow recesses 440, 442 in the pump face 153B. The drip cup 412 is located in position by pins 424 engaging in holes 422 in the flanges 418, 420 as described for FIG. 9. The extension fits in an elongate channel 410 in the lower portion of the pump face 153B, similar to channel 310 in FIG. 9, and is also provided on opposite sides about halfway along its length with a light source 166 and sensor 167. However, it should be noted that the bottom wall 416 of the extension 414 is spaced a small distance above the open lower end of the channel 410. As before, the rear upper edge 426 of the cup 412 slopes upwardly from left to right, but below the pump rotor 158 without a central cutaway portion. The funnel shape of the cup 412 accelerates drainage of any paint leakage into the extension 414. As the pump rotor 158 rotates anticlockwise in FIG. 10 during pumping in the forward direction, and rupturing or other failure of the pump tube is more likely to occur during normal pumping when supplying the paint applicator, having the drip cup 412 higher on the righthand side of FIG. 10 increases the likelihood of all leakage paint entering the drip cup, particularly leakage paint thrown off centrifugally by the rotor 158.

Figure 11:
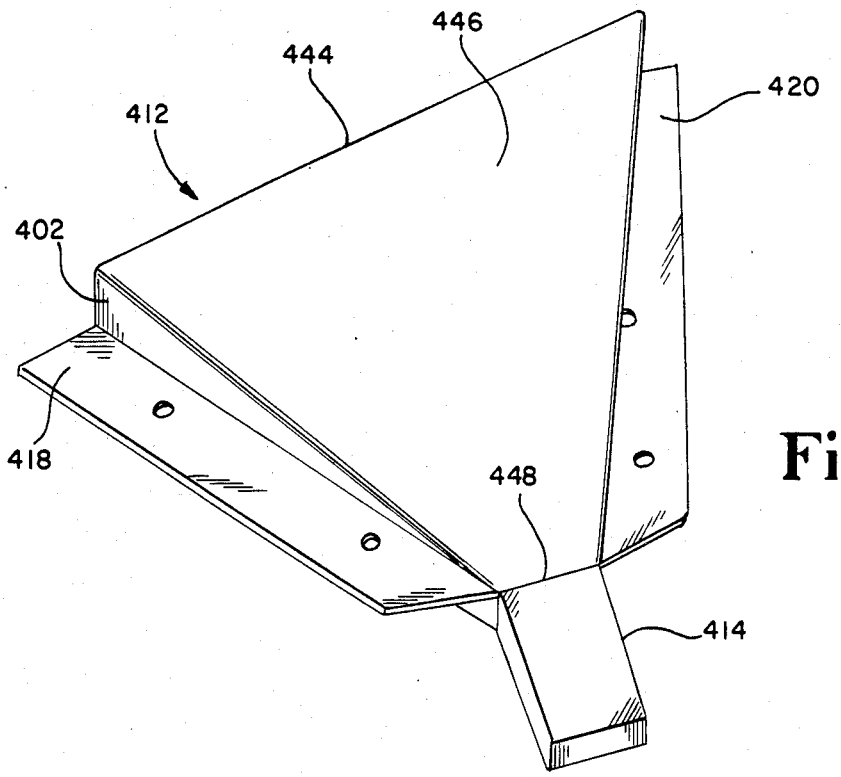
FIG. 11 is a perspective view of the drip cup of FIG. 10.

FIG. 11 shows a frontal perspective view of the drip cup 412 clearly showing a rectangular shape (in cross-section) of the extension 414 and the thin flat side flanges 418, 420. The front upper edge 444 of the cup is straight and inclined similar to the back upper edge 426 (FIG. 10). It will be noted that the side flange 418 commences at the junction 448 between the extension 414 and the front wall 446 and terminates upwardly partway across the top of the side wall 402; the other flange 420 similarly teminates upwardly partway across the top of the other side wall 404.

Figure 12:
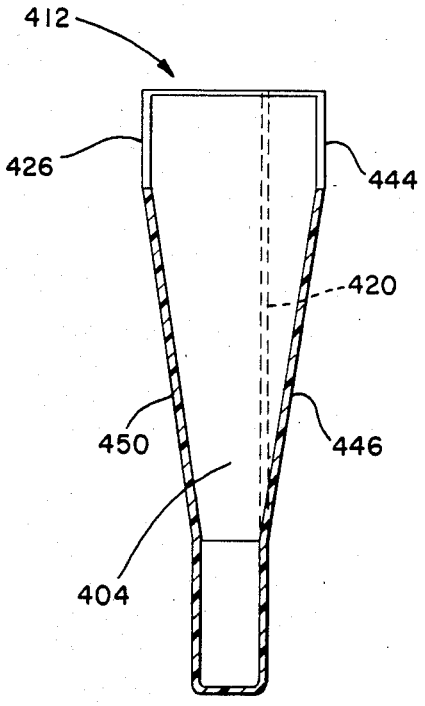
FIG. 12 is a section on the line 12—12 of FIG. 10 of the drip cup thereof.

FIG. 12 shows a longitudinal section of the drip cup 412 on the line 12—12 in FIG. 10. The position of the side flange 420 is shown in broken lines, and can be seen to extend upwardly in approximately a vertical plane from the bottom of the front wall 446 to a point intermediate the length of the upper edge of the side wall 404, this point being at approximately one third the depth of the open top of the cup from the front. The upwardly sloping upper edges 426, 444 of the back and front walls 450,446, respectively, are parallel. Also, the back and front walls 450, 446 diverge upwardly away from the side flange 420 (and the corresponding but shorter side flange 418). The back and front walls 450, 446 converge towards each other from left to right in FIGS. 10 and 11 in order for the upper sloping edges 426, 444 to be parallel. The drip cup 412 is made similarly to drip cup 312 by molding from clear plastic, is transparent, and is readily replaceable.

Figure 13:
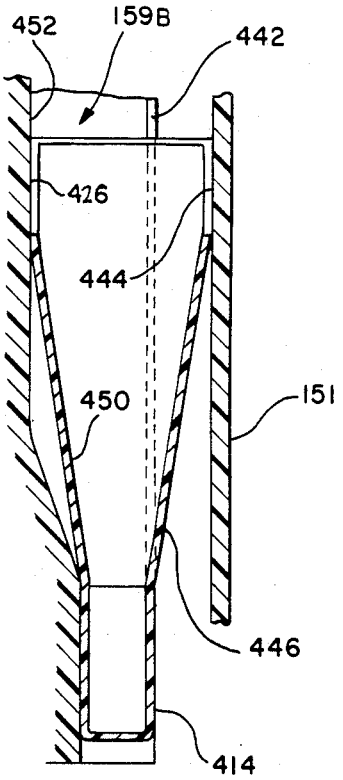
FIG. 13 is a fragmentary diagrammatic illustration taken on the line 12—12 of FIG. 10 showing the door of the pump housing closed and engaged with the top of the drip cup.
Figure 14:
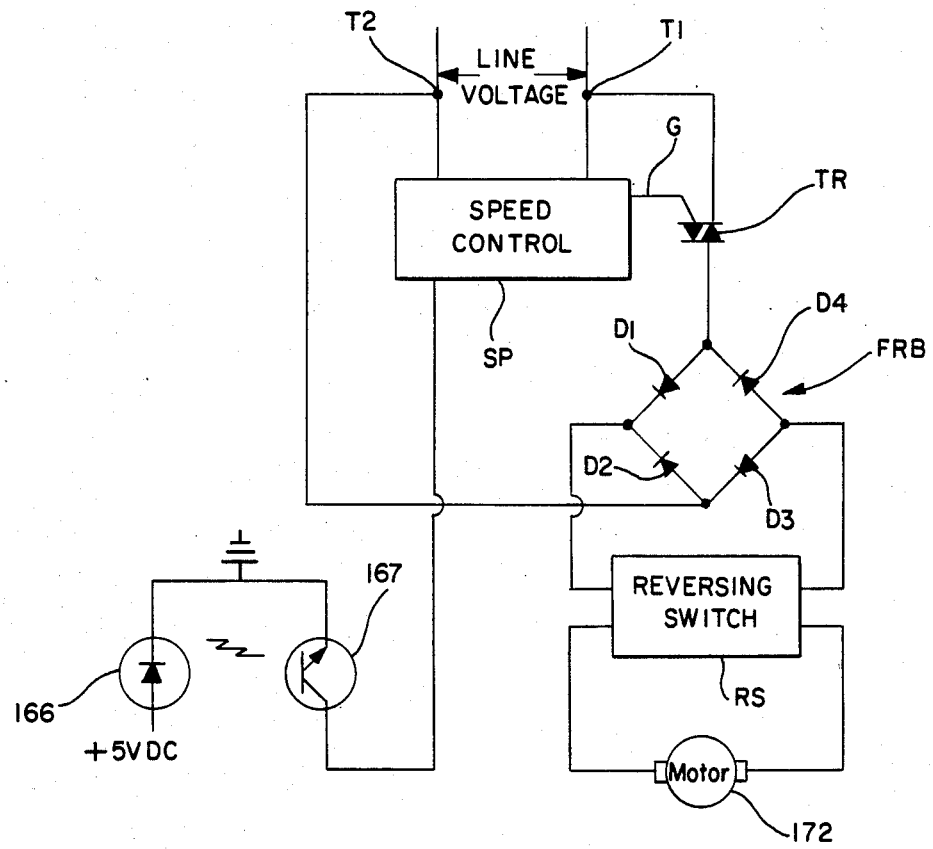
FIG. 14 is a schematic electrical circuit of the leakage detector of the embodiments of FIGS. 1, 9 and 10.

FIG. 13 is a view of the drip cup 412 similar to that in FIG. 12 but showing it in position in the pump cavity 159B with the door 151 of the pump cavity closed. The upper parallel edges 416 and 444 of the back and front walls of the drip cup contact and are squeezed between the back 452 of the pump cavity 159B and the closed door 151 parallel thereto. In this way an improved seal is obtained between these parts to minimize leakage paint seeping down the outside of the drip cup. The upwardly diverging side walls 402, 404 of the drip cup, when they are squeezed, also aid in obtaining a sealing fit of the top side edges of the cup against the side walls of the pump cavity. As can be seen, the back and front walls 450 and 446 diverge inwardly and downwardly away from the pump cavity back wall and the closed door, respectively. However, the lower portion of the cavity back wall slopes downwardly and forwardly towards the top of the extension 414. As will be appreciated, the thin walls of the drip cup are somewhat resiliently flexible, and the back and front upper edges 416, 444 may, for example, be squeezed 2 mm towards each other when closing the door 151.

Although in FIGS. 9 and 10 the cups 312 and 412 are preferably made of clear plastic, only the extensions 314 and 414 may be transparent and clear. Also, these extensions 314, 414 could be detachably secured to the bodies of the cups 312, 412 so that only the extension is replaced, and not the whole cup, after paint leakage has occurred.

It will be appreciated, that in all three embodiments, having the front of the channels 164, 310, 410 open facilitates access to the operative surfaces of the light source 166 and the photoelectric sensor 167 for both inspection and cleaning, particularly as these channels are elongated to increase sensitivity of leakage detection. In the embodiments of FIGS. 9 and 10, this open front of the channels also enables the drip cup to be inserted and removed in a direction perpendicular to the back wall of the pump cavity.

FIG. 14 shows a simplified circuit schematic of the leakage detector, and is applicable to all the above three embodiments. Line voltage, e.g. 120 volt 60 cycle AC, is supplied across terminals T1, T2 when the main power switch 212 (see FIG. 3) and the ON switch 215 (see FIG. 6) are switched on. Full wave rectified DC is then supplied to the motor 172 via a triac TR, a full wave rectifier bridge FRB comprising four diodes D1, D2, D3, D4, and a reversing switch RS. The direction of rotation of the motor 172 will depend upon the setting of the reversing switch RS as controlled by actuation of the switch button 218 or 219 (see FIG. 6). Speed control circuitry SP, of any design well known in the art, has an output connected by lead G to the gate of the triac TR for controlling the amount of power passed by the triac, as is well known in the art. The photoelectric sensor 167, which is shown as a photocell, has its collector connected into the speed control circuitry SP and its emitter connected to ground. The light source 166, shown as a light emitting diode, having its anode supplied constantly with a source of positive 5 volt DC obtained in known manner by transforming and rectifying the line voltage across terminals T1, T2. The cathode of the diode 166 is connected to ground. While line voltage is supplied across terminals $T_1$, $T_2$, the LED 166 emits light which is received by the base of the photocell 167 so rendering the photocell continuously conductive. Whenever the beam of light from the LED 166 to the photocell 167 is interrupted, the photocell 167 becomes non-conductive so influencing the speed control circuitry SP to inactivate the gate of the triac TR which then also becomes non-conductive and stops the motor 172. It will be appreciated that power to the motor 172 is thus interrupted regardless of the direction of rotation of the motor. The speed control circuitry is preferably designed, for example by incorporation of a flip-flop, so that once the photocell 167 becomes non-conductive the gate of the triac cannot be reactivated until the system is reset, e.g. by actuation of a reset button which, for example, could be the alert button 228 in FIG. 6. The alert light 221 (FIG. 6) is illuminated while there is power supplied across the terminals T1, T2 and the triac TR is not conductive, for example the alert light can be connected into the speed control circuitry so that it is switched on when the photoelectric sensor 167 becomes nonconductive.

The above described embodiments, of course, are not to be construed as limiting the breadth of the present invention. Modifications, and other alternative constructions, will be apparent which are within the spirit and scope of the invention as defined in the appended claims.

For example, the light source and the photoelectric sensor could be positioned adjacent each other on one side of the drain passageway, a reflector being positioned on the opposite side of the passageway and arranged to reflect light from the light source back to the sensor. Also, the light source and the sensor, or even just the above reflector, could be mounted in the extension of the drip cup which would then, possibly, be a more permanent unit which may have a replaceable extension or a replaceable transparent section of the extension. However, the drip cup preferably would still be readily removable for cleaning.

What is claimed is:

1. Painting apparatus, comprising:

a pump housing;

a pump in said housing, said pump comprising a pump face, a paint pumping tube, a tube support cam, a rotatable carrier, and pumping rollers circularly disposed around and mounted on said carrier;

a motor drivingly connected to said pump for rotating said carrier;

said pump face being comprised principally of upstanding horizontally facing surfaces, and including a cavity receiving said pumping tube;

said cavity having a lowermost point and being shaped to drain to said point;

a leakage directing passageway communicating at an upper end with said lowermost point and extending lengthwise downward therefrom;

a light source disposed on one side of said passageway;

photoelectric sensor means, disposed on another side of said passageway opposite said light source, for receiving light from said light source;

said light source and said photoelectric sensor means being disposed intermediate the length of said passageway;

said photoelectric sensor means being responsive to paint draining from said cavity downwards inside said passageway past said light source to stop said motor; and alert means for signalling said photoelectric sensor means has stopped said motor in response to said draining paint.

2. The painting apparatus of claim 1, wherein said passageway has at least one bend therein.

3. The painting apparatus of claim 1, wherein said passagewayis open along the length thereof on one side.

4. The painting apparatus of claim 3, further comprising a door connected to said housing and movable relative to said pump face between an open position exposing said cavity and said passageway and a closed position covering said cavity and said passageway.

5. The painting apparatus of claim 1, further comprising a drip cup located in said cavity below said rotatable carrier and having a downward transparent extension engaged in said passageway.

6. The painting apparatus of claim 1, further comprising a transparent drip cup located in and conforming to the shape of a lower portion of said cavity to collect any paint leaking in said cavity from said pumping tube, said cup having a downward extension engaged in said passageway and extending past said light source and said photoelectric sensor means, a bottom of said downward extension being closed.

7. The painting apparatus of claim 1, wherein said alert means comprises an indicator light on a control panel for said motor, said control panel being connected to said housing and having manually operable controls for controlling operation of said motor.

8. Painting apparatus, comprising:

a peristaltic pump for pumping paint from a supply to an applicator remote from said supply;

a motor drivingly connected to said pump for operation thereof;

said peristaltic pump comprising a pump cavity in a pump face, a pumping tube passing through said cavity, and means for acting upon said tube to pump paint therethrough;

said cavity having a back wall and opposing side walls, lower portions of said side walls converging downwardly to a lowermost point of said cavity;

an elongate drainage passage having an inlet end communicating with said lowermost point and extending downwards therefrom in said pump face to an open outlet end spaced below said inlet end;

a light source and photoelectric sensor means disposed adjacent said passage at a location intermediate the length of said passage between said inlet and said outlet, said photoelectric sensor means receiving light from said light source;

said photoelectric sensor means functioning to sense any interruption in receiving said light due to paint leaking in said cavity from said pumping tube and passing down said passage, and in response thereto functioning to stop said motor driving said pump; and said passage being open on a front side along the length of said passage from said inlet to said outlet.

9. The painting apparatus of claim 8, further comprising a hinged door connected to said pump face and pivotal between a closed position covering said cavity and the front side of said passage and an open position exposing said cavity and said passage.

10. The painting apparatus of claim 8, further comprising a drip cup located in said cavity to receive paint leaking into said cavity, said cup having a downward transparent extension engaged in said passage and extending past said light source.

11. The painting apparatus of claim 10, wherein a bottom of said extension is closed, and a top edge of said cup is located below but adjacent said acting means.

12. The painting apparatus of claim 8, further including an indicator light mounted on a control panel of said pump, said light being turned on when said photoelectric sensor means senses leakage paint in said passage.

13. The painting apparatus of claim 8, comprising a gated semi-conductor switch for controlling supply of electrical power to said motor, and circuit means for controlling the speed of said motor connected to the gate of said semi-conductor switch, and wherein said photoelectric sensor means comprises a photocell connected to said circuit means for extinguishing said semi-conductor switch when leakage paint interrupts the receiving of light from said light source.

14. Painting apparatus, comprising:

a pump having a pump cavity in a pump face, a pumping tube in said cavity, and means for acting upon said tube to pump paint therethrough;

said cavity extending below said pumping tube and being provided with a drain passage;

a photoelectric sensor arranged to receive light from a light source, said sensor and said light source being associated with said passage for sensing leakage of paint from said pumping tube;

a container fitted in said cavity below said pumping tube to receive such leakage paint from said pumping tube;

said container having a downward extension extending into said passage, said extension allowing transmission of light from said light source to said sensor; and means, electrically connected to said sensor, for stopping pumping by said pump when said leakage paint drains into said extension and impedes receipt of light by said sensor.

15. The painting apparatus of claim 14, wherein said sensor and said light source are disposed in said pump face alongside said passage.

16. The painting apparatus of claim 15, wherein said sensor and said light source are disposed on opposite sides of said passage.

17. The painting apparatus of claim 14, wherein said container is made of transparent material, and a bottom of said extension is closed.

18. The painting apparatus of claim 14, wherein said container is funnel-shaped to facilitate drainage into said extension, flanges are provided on opposite sides of said container, and location pins provided on said pump face engage in holes in said flanges to locate said container in said cavity.

19. The painting apparatus of claim 14, wherein said pump is provided with a door exposing said cavity when open and covering said cavity when closed, and said container has an open top with back and front edges a greater distance apart than the distance between a back of said cavity and said door when closed, whereby closing said door squeezes said back and front edges closer together to seal these edges against said cavity back and said door.

20. The painting apparatus of claim 19, wherein said container has back and front walls which diverge upwardly from said extension to said back and front edges.

21. The painting apparatus of claim 20, wherein said container is molded from transparent plastic material and has integral flanges on opposite sides which are received in shallow recesses in said pump face alongside said cavity, said back and front walls both diverging upwardly away from said flanges.

22. Painting apparatus, comprising:

a peristaltic pump having a pump body with a pumping tube in a cavity in said body, and means for acting upon said tube to pump paint therethrough;

said cavity having a back wall, opposing side walls, and an elongate drain passage extending downwardly from between said side walls;

a light source;

photoelectric sensor means for receiving light from said light source for sensing leakage of paint from said pumping tube, said sensor means and said light source being disposed alongside said passage intermediate the length thereof;

a transparent, funnel-like container removably located in said cavity below said acting means for collecting such leakage paint, said container having a downward spout-like extension engaged in said passage, a bottom of said extension being below said sensor and said light source and being closed;

said container having flanges on opposite sides releasably connected to said pump body adjacent said side walls; and means, electrically connected to said sensor, for stopping pumping by said pump when said leakage paint drains into said extension and impedes receiving of light by said sensor means.

23. The painting apparatus of claim 22, wherein:

said pump has an electric motor drivingly connected to said acting means for rotation thereof;

said pump is provided with a door movable relative to said pump body to expose said container when open and to squeeze said container against said back wall when closed; and said stopping means comprises means for controlling the speed of said motor and connected to control conductivity of a gated semi-conductor switch connected in series with said motor.

* * * * *